United States Patent [19]

Giroux

[11] Patent Number: 4,784,565

[45] Date of Patent: Nov. 15, 1988

[54] BEAM PICKER

[76] Inventor: D. William Giroux, 3 Lakewood villa, Council Buffs, Iowa 51501

[21] Appl. No.: 90,710

[22] Filed: Aug. 31, 1987

[51] Int. Cl.[4] ..... B66C 1/64

[52] U.S. Cl. ..... 414/735; 405/232; 414/10; 414/741; 414/743

[58] Field of Search ..... 414/729, 732, 735, 743, 414/738, 741, 912, 10, 11, 589, 590, 731, 739, 740; 212/266; 405/303, 232, 246; 901/29

[56] References Cited

U.S. PATENT DOCUMENTS

| | | | |
|---|---|---|---|
| 2,700,483 | 1/1955 | Cook et al. | 414/743 |
| 2,727,639 | 12/1955 | Ball et al. | 414/743 X |
| 2,738,081 | 3/1956 | Lee | 414/743 X |
| 3,773,200 | 11/1973 | Morris | 414/743 X |
| 4,229,136 | 10/1980 | Panissidi | 901/29 X |
| 4,280,785 | 7/1981 | Albrecht | 414/735 |
| 4,676,713 | 6/1987 | Voelpel | 901/29 X |

FOREIGN PATENT DOCUMENTS

| | | | |
|---|---|---|---|
| 962233 | 2/1975 | Canada | 414/731 |

*Primary Examiner*—Leslie J. Paperner

*Attorney, Agent, or Firm*—Zarley, McKee, Thomte, Voorhees & Sease

[57] ABSTRACT

A beam picker adapted to be mounted on the boom tip of a conventional hydraulic crane is described to facilitate the removal of shoring beams positioned beneath a completed structure. The beam picker comprises a first support which is mounted on the outer end of a hydraulic crane and which has a second support pivotally secured thereto about a horizontal axis. A third support is rotatably and pivotally mounted on the second support so that the third support may be rotated and tilted relative to the second support. Movable jaws are provided on the third support for grasping the lower flange of the shoring beam.

3 Claims, 5 Drawing Sheets

BEAM PICKER

BACKGROUND OF THE INVENTION

This invention relates to a beam picker and more particularly to a device which is designed to be used in conjunction with a conventional hydraulic crane to enable shoring beams to be removed from beneath bridges or the like after the bridges have been completed.

When modern post tension bridges are constructed, the forms and concrete mass are normally supported by falsework towers and temporary structural beams or shoring beams. In such a structure, the concrete is poured in place and supported by falsework until after the bridge is post tensioned with high strength cable strands.

In the typical construction of such a bridge, the towers and the grid of supporting steel beams which support the wood or metal forms are easily put into place using conventional construction cranes. The bridge constructed in this manner is usually positioned over another roadway such as used in the interstate exchanges involving off ramps, on ramps, cloverleafs, etc. Thus, in this type of construction, the bridges are built on land which allows support towers to be placed at frequent intervals to support the extreme weight of the bridge during the construction phase and prior to post tensioning. In such a construction operation, there is usually no overhead obstruction for the bridge. Conventional cranes can swing and set the towers and the support beams using conventional rigging methods. The load is normally supported by hoist lines extending from cranes and rigging cables.

However, after the bridge is poured and post tensioned, it is necessary to remove the support steel and the towers supporting the same from beneath the new structure. Such a removal operation has troubled the industry and methods to overcome the same have only been partly successful. In the past, some of the beams have been removed by the "crash method". This method amounts to typing a cable to the beam to be removed and utilizing a large piece of equipment to physically drag the beam off the supporting towers and let it crash to the ground. This method is extremely damaging to the beams or anything the beams might hit on their drop to the ground. Such a method is also dangerous to workers in the area not only from the falling beam but from boards and lumber hit by the beam which may fly in unknown and unpredictable directions.

In certain instances, the entire section of the falsework may be lowered by winches. While the winch method may be a good method, it is not always possible or desirable to use this method. Even if the steel grid is lowered in large sections by winches, it is still necessary to remove the shoring support towers prior to the lowering operation. This necessitates removal of the towers by some means prior to the lowering of the steel grid.

It is therefore a principal object of the invention to provide a beam picker which may be attached to the boom tip of a conventional hydraulic crane.

Yet another object of the invention is to provide a beam picker which includes means for clamping onto the beam to be removed, tilting the beam and rotating the beam.

A further object of the invention is to provide a beam picker adapted to be mounted on the boom tip of a hydraulic crane which may be easily installed on the crane or removed therefrom.

Yet another object of the invention is to provide a beam picker of the type described which may be positioned beneath most structures by the hydraulic crane, grasp a beam by clamping the bottom flange thereof and removing the beam with the apparatus having the ability to tilt the beam, move the beam laterally, or rotate the beam.

Still another object of the invention is to provide a device of the type described which is safe to use.

These and other objects will be apparent to those skilled in the art.

SUMMARY OF THE INVENTION

Figure 1:
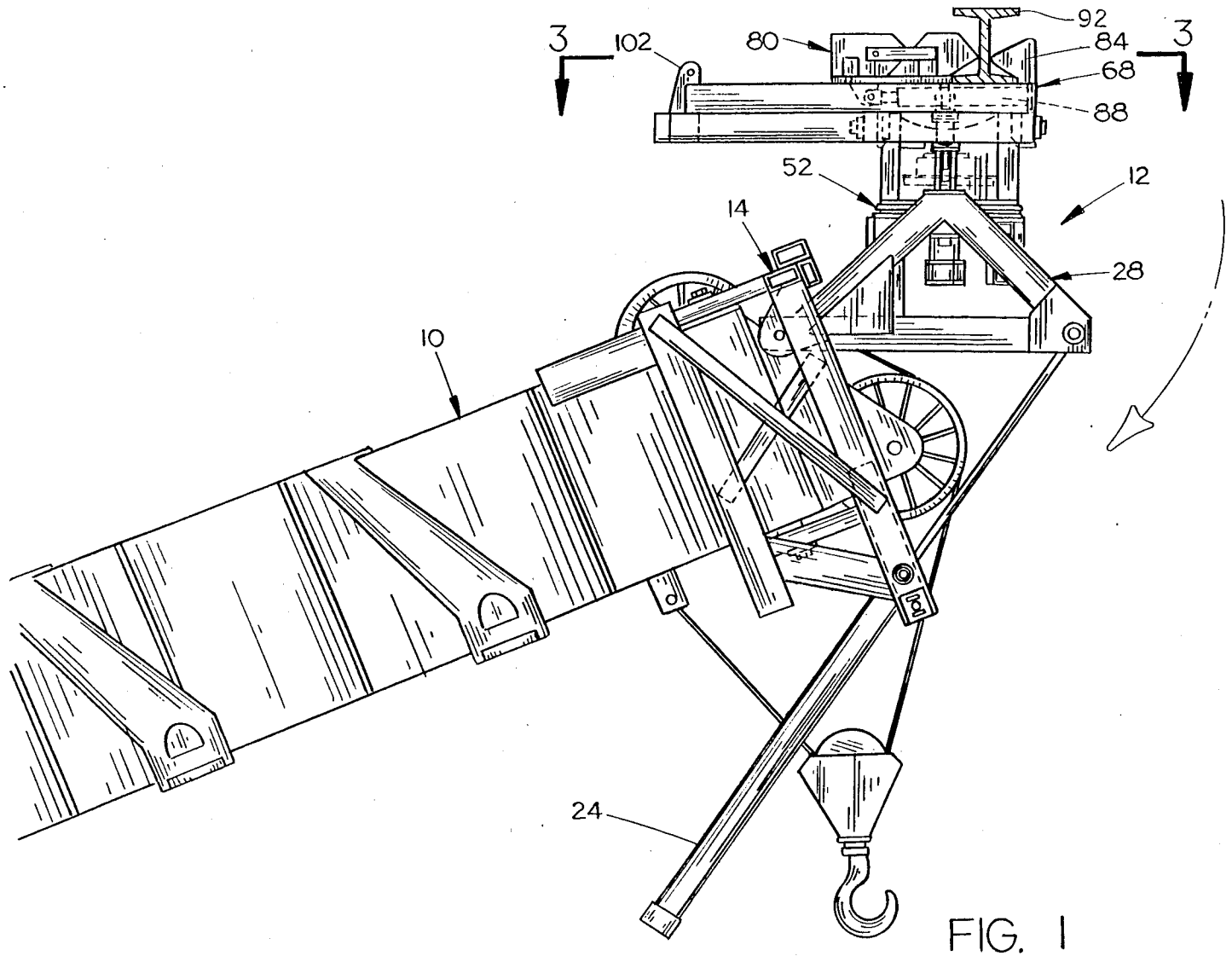
FIG. 1 is a side view of the beam picker of this invention mounted on the boom tip of a crane.
Figure 2:
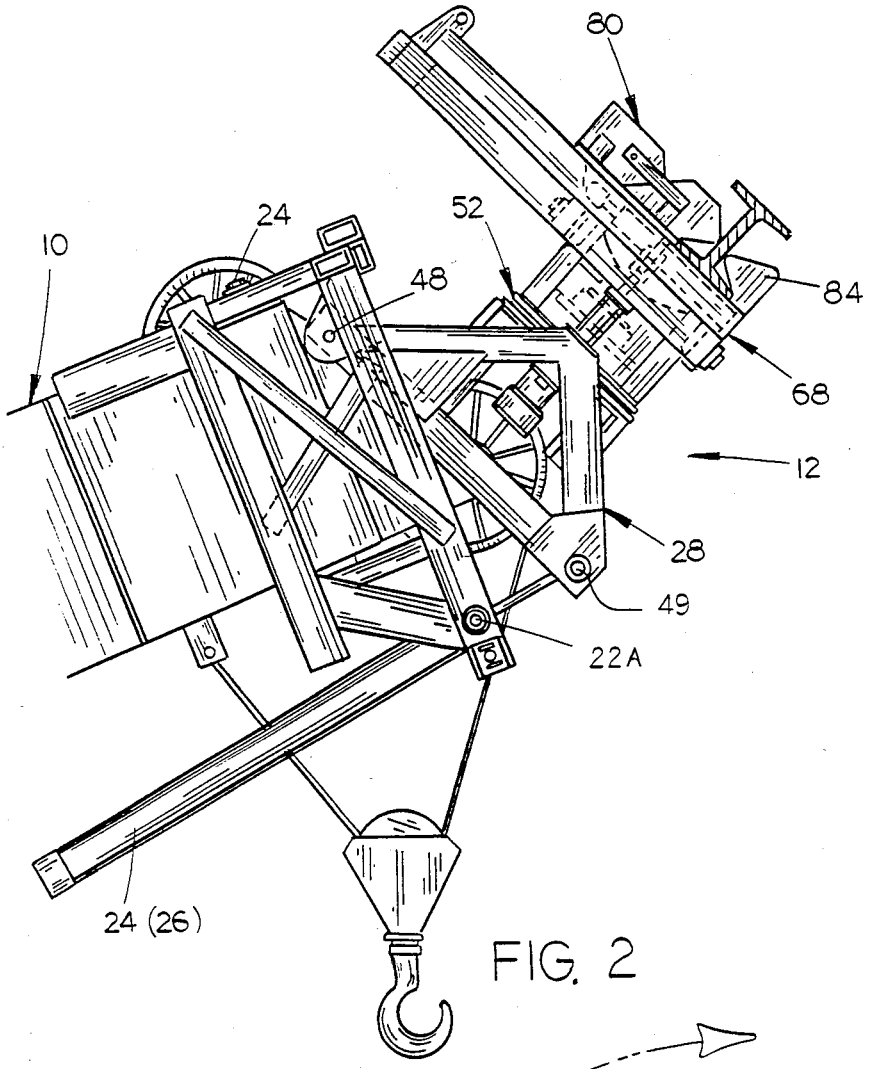
FIG. 2 is a view similar to FIG. 1 except that the beam picker has been pivotally moved relative to the crane.
Figure 3:
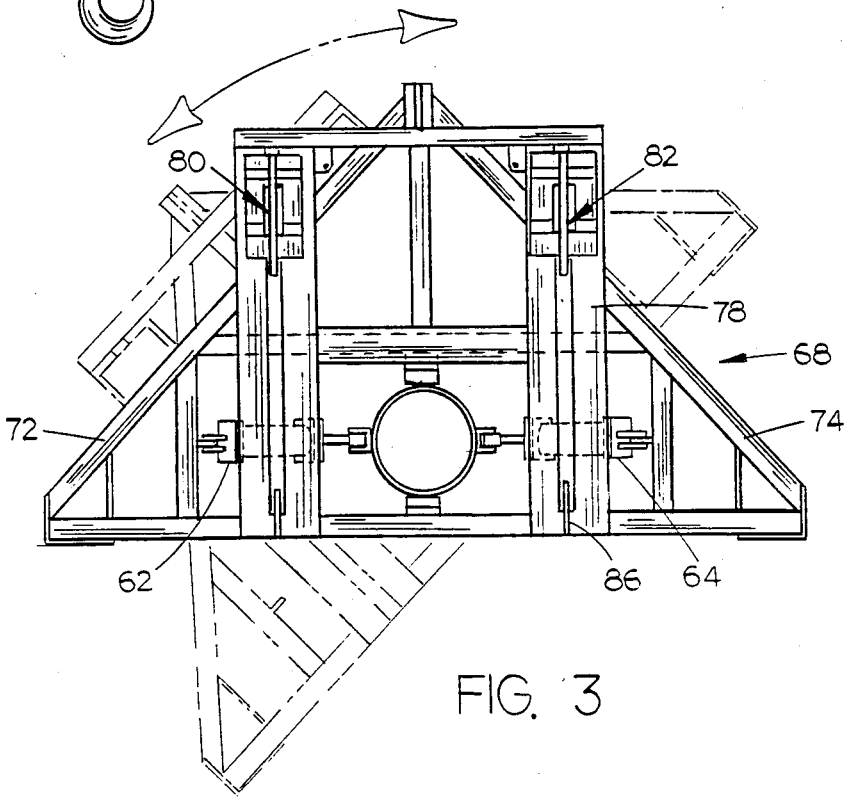
FIG. 3 is a sectional view as seen on lines 3—3 of FIG. 1.
Figure 4:
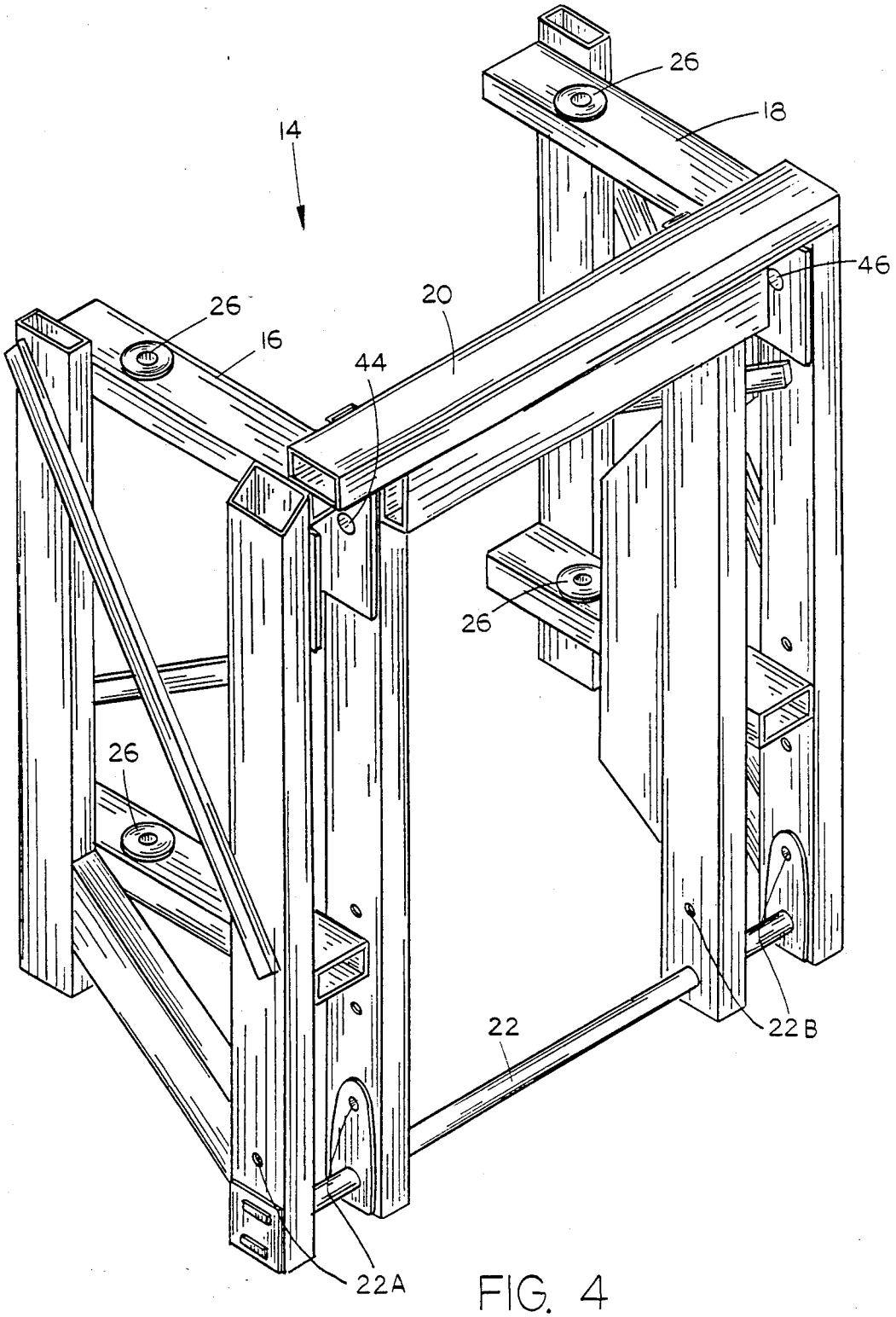
FIG. 4 is a perspective view of a portion of the beam picker.
Figure 5:
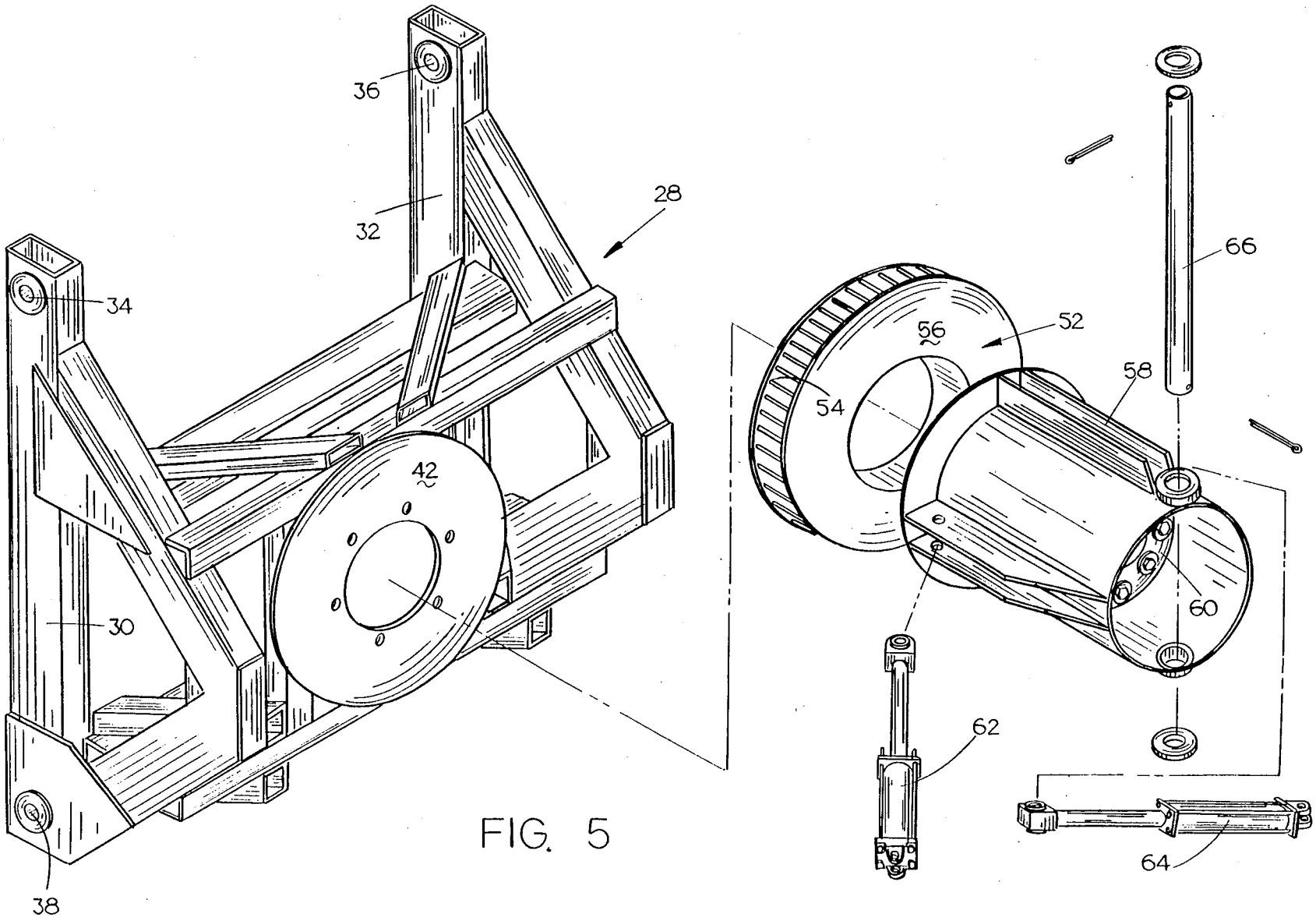
FIG. 5 is an exploded perspective view of a portion of the beam picker.
Figure 6:
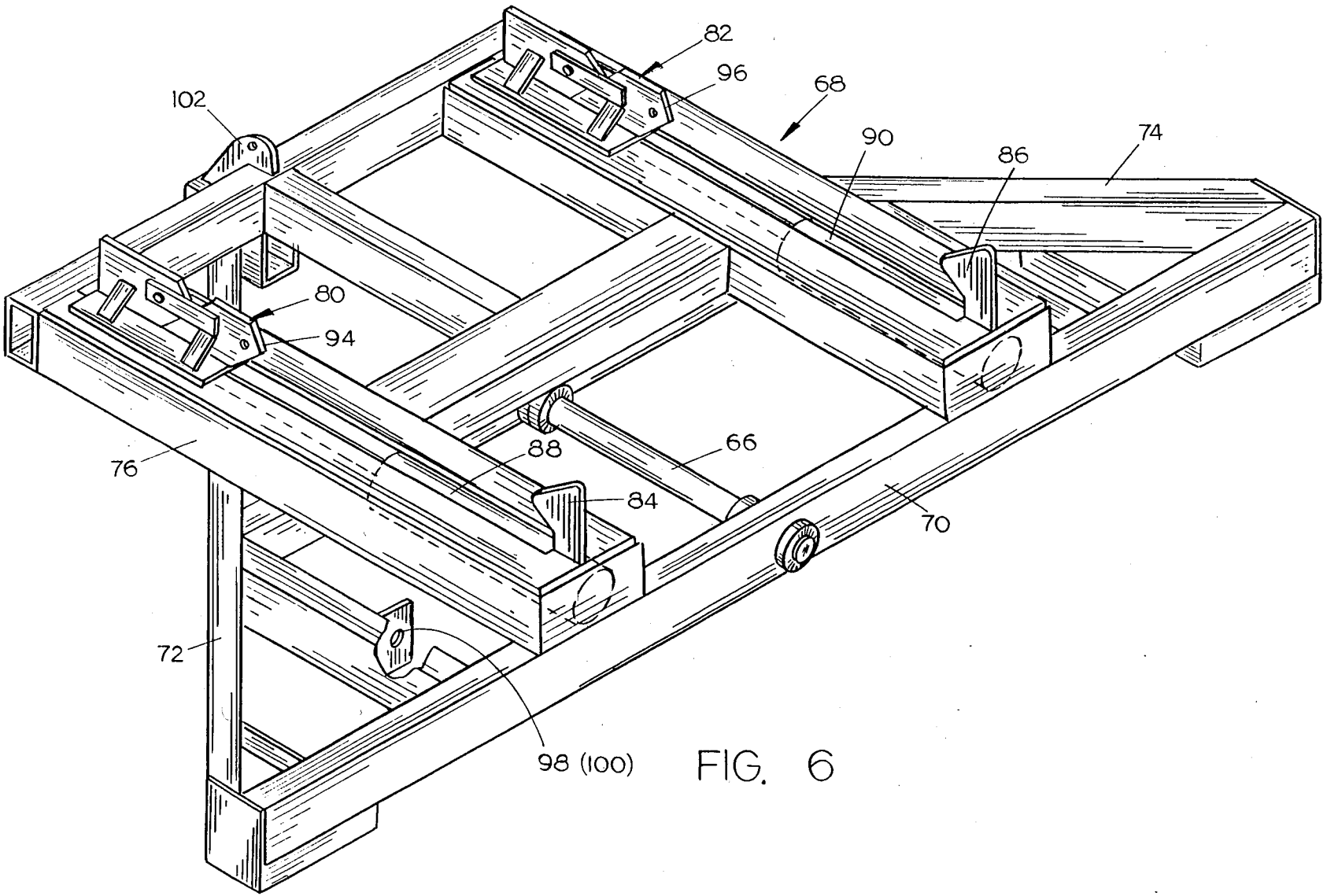
FIG. 6 is a perspective view of a portion of the beam picker invention.

A beam picker is described which may be mounted on the boom tip of a conventional hydraulic crane to facilitate the removal of shoring beams positioned beneath a completed structure. The beam picker comprises a first support means which is mounted on the outer end of the hydraulic crane and which has a second support means pivotally secured thereto about a horizontal axis. A third support means is rotatably and pivotally mounted on the second support means so that the third support means may be rotated and tilted relative to the second support means.

When the beam picker is mounted on the crane, the crane will be utilized to properly position the beam picker. The second and third support means are selectively pivoted, rotated or tilted, or any combination thereof, to enable the clamping means on the third support means to clamp onto the lower flange of the shoring beam to be removed. Once the clamping means has clamped onto the lower flange of the shoring beam, the second and third support means may be selectively pivotally and rotatably moved to maneuver the beam to the desired position.

DESCRIPTION OF THE PREFERRED EMBODIMENT

The numeral 10 refers to the boom tip of a conventional hydraulic crane such as a Grove RT760 or Grove RT745 crane. The beam picker of this invention is referred to generally by the reference numeral 12 and may be secured to the boom tip 10 of the crane in a relatively simple fashion without affecting the normal operation of the crane.

Beam picker 12 includes a support mast or support means 14 including side frames 16 and 18 and front frame 20. As seen in the drawings, a structural tie bolt 22 is provided at the lower forward end of support means 14. A pair of hydraulic cylinders 24 and 26 are pivotally mounted on trunion mounts 22A and 22B respectively. Pins 25 or other suitable connectors are extended through openings 27 and secured to the outer boom tip 10 to rigidly mount the support means 14 thereon.

A second or intermediate support means 28 is pivotally mounted on support means 14 as will now be described. Support means 28 includes a pair of frame members 30 and 32 having openings 34 and 36 provided at the upper ends thereof respectively. The lower ends of frame members 30 and 32 are provided with openings 38 and 40 (not shown) respectively. Circular disk or plate 42 is mounted on the forward end of support means 28 as seen in the drawings. The upper ends of frames 30 and 32 are pivotally secured to support means 14 at 44 and 46 by suitable pins 48. The rod ends of cylinders 24 and 26 are pivotally connected to the lower ends of frames 30 and 32 by means of pins 49 and 50 (not shown) extending through openings 38 and 40 respectively.

The numeral 52 refers to a Rotek bearing comprising bearing portions 54 and 56 which are rotatable with respect to each other. Bearing portion 54 is bolted to plate 42 as seen in the drawings. Rotating support housing 58 is secured to bearing portion 56 for rotation therewith. Gear box 60 is positioned within housing 58 and is adapted to cause rotation of housing 58 and bearing portion 56 relative to plate 42 by means of a conventional hydraulic motor.

A pair of hydraulic cylinders 62 and 64 have their rod ends pivotally secured to housing 58 for a purpose which will be described in more detail hereinafter. Shaft 66 extends through the forward end of housing 58 to effect a rotatable or pivotal connection between support means 28 and the support means 68 which is provided on the beam picker as will now be described.

Support means 68 includes a forward frame member 70 having frame members 72 and 74 extending rearwardly and inwardly from the opposite ends thereof. A pair of channel members 76 and 78 are positioned on the frame members 70, 72 and 74 as illustrated in the drawings and have clamping assemblies 80 and 82 movable mounted thereon. Upright brackets or clamp halves 84 and 86 are provided at the forward ends of the channel members 76 and 78 and are designed to cooperate with the members 80 and 82 as will be described hereinafter.

Hydraulic cylinders 88 and 90 are positioned within channel members 76 and 78 and have their base ends secured to the forward ends thereof. The rod ends of cylinders 88 and 90 are connected to the members 80 and 82 respectively to move the members 80 and 82 towards the brackets 84 and 86 to clamp the beam 92 therebetween. Clamp portions 94 and 96 are selectively removably secured to members 80 and 82 to enable the apparatus to accommodate smaller beams at times. As seen in the drawings, shaft 66 is mounted on the support means 68 to enable the support means 68 to be pivoted or tilted relative to the motor housing 58 when the cylinders 62 and 64 are actuated. The base ends of cylinders 62 and 64 are pivotally connected to support means 68 at 98 and 100. Support means 68 is also provided with a bracket 102 at its rearward end to enable the support means 68 to be secured to the upper ends of suppport towers if the apparatus is being used to move support towers.

The beam picker of this invention may be easily and quickly mounted on the boom tip of a conventional crane and distracts only slightly from the picking capacity of the machine. Once attached, the crane maneuvers the beam picker 12 relative to the shoring beam to be removed from beneath the completed structure. Initially, cylinders 24 and 26 will be extended so that support means 28 is positioned in a generally horizontally disposed position such as illustrated in FIG. 1 with the support means 68 also being generally horizontally disposed.

Clamping assemblies 80 and 82 are then "opened" by extending the cylinders 88 and 90 to move assemblies 80 and 82 away from brackets 84 and 86. Support means 68 may be rotated, with respect to support means 28, by means of the hydraulic motor connected to gear box 60. Support means 68 may also be tilted or pivoted relative to support means 28 by actuating the cylinders 62 and 64 as required. Thus, the clamping assemblies 80 and 82 may be precisely positioned relative to the beam 92 so that the lower flange thereof is positioned adjacent brackets 84 and 86. Cylinders 88 and 90 are then retracted to cause assemblies 80 and 82 to move towards brackets 84 and 86 to clamp the lower flange of the beam therebetween.

When the beam has been clamped, the beam may be removed by the crane. The beam may be tilted, moved right or left, tipped and slipped inward or outward to permit the convenient removal of the same. The crane would then lower the beam to the ground and the clamping assemblies opened to remove the beam. The crane would then reposition the beam picker to remove another beam from the supporting structure. Thus it can be seen that the apparatus of this invention accomplishes at least all of its stated objectives.

I claim:

1. In combination with a crane having an extendible and pivotal boom, a first support means removably mounted on the end of the boom and having upper and lower ends, a second support means having upper and lower ends, means pivotally connecting, about a horizontal axis, the upper end of said second support means to the upper end of the said first support means, a beam clamping support means pivotally and rotatably mounted on said second support means, means for rotating said beam clamping support means relative to said second support means, means for pivoting said beam clamping support means relative to said second support means, and a beam clamping assembly movably mounted on said beam clamping support means adapted to clamp onto a beam to facilitate the movement thereof, said beam clamping assembly including at least one pair of clamp halves movable between a clamped position, wherein said clamp halves cooperate to grip a beam, and an unclamped position, and power means for operably moving at least one of said clamp halves, at least one of said clamp halves being slidably mounted for movement toward and away from the other clamp half, and operably connected to said power means.

2. In combination with a crane having an extendible and pivotal boom, a first support means removably mounted on the end of the boom and having upper and lower ends, a second support means having upper and lower ends, means pivotally connecting, about a horizontal axis, the upper end of said second support means to the upper end of the said first support means, a beam clamping support means pivotally and rotatably mounted on said support means, means for rotating said beam clamping support means relative to said second support means, means for pivoting said beam clamping support means relative to said second support means, and a beam clamping assembly movably mounted on said beam clamping support means adapted to clamp onto a beam to facilitate the movement thereof, said beam clamping assembly including at least one pair of clamp halves movable between a clamped position, wherein said clamp halves cooperate to grip a beam, and an unclamped position, and power means for operably moving at least one of said clamp halves, at least one of said clamp halves being slidably mounted for movement toward and away from the other clamp half, and operably connected to said power means.

3. In combination, a crane having an extendible and pivotable boom, and a shoring beam handling apparatus mounted on the end of said boom, said beam handling apparatus including clamping means adapted to clamp onto the shoring beam, said clamping means including at least one pair of clamp halves movable between a clamped position, wherein said clamp halves cooperate to grip a beam, and an unclamped position, and power means for operably moving at least one of said clamp halves, said beam handling apparatus also including means for pivoting, tilting and rotating said clamping means for positioning said clamping means relative to a shoring beam to facilitate the clamping thereof and for maneuvering the shoring beam after said clamping means has been clamped onto the shoring beam, each said clamp half including a generally triangular-shaped plate member with their apexes oriented to contact the web portion of a shoring beam while in the clamped position.

* * * * *